US008922437B2

(12) United States Patent
Kim

(10) Patent No.: US 8,922,437 B2
(45) Date of Patent: Dec. 30, 2014

(54) EXTERIOR ANTENNA STRUCTURE OF MOBILE TERMINAL

(75) Inventor: Sung Sun Kim, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 768 days.

(21) Appl. No.: 13/031,908

(22) Filed: Feb. 22, 2011

(65) Prior Publication Data

US 2011/0205143 A1 Aug. 25, 2011

(30) Foreign Application Priority Data

Feb. 24, 2010 (KR) ..... 10-2010-0016468

(51) Int. Cl.
*H01Q 1/24* (2006.01)
*H01Q 1/08* (2006.01)

(52) U.S. Cl.
CPC . *H01Q 1/244* (2013.01); *H01Q 1/08* (2013.01)
USPC ..... 343/702; 343/900; 343/901

(58) Field of Classification Search
CPC ..... H01Q 1/10; H01Q 1/085; H01Q 9/30
USPC ..... 343/702, 900, 901
See application file for complete search history.

(56) References Cited

U.S. PATENT DOCUMENTS

| | | | | |
|---|---|---|---|---|
| 6,429,817 | B1 * | 8/2002 | Creigh et al. | 343/702 |
| 2006/0164310 | A1 * | 7/2006 | Vesterinen | 343/702 |
| 2008/0158088 | A1 * | 7/2008 | Mai et al. | 343/834 |
| 2009/0102727 | A1 * | 4/2009 | Oh | 343/702 |

FOREIGN PATENT DOCUMENTS

JP 2007-214673 A 8/2007

* cited by examiner

*Primary Examiner* — Dameon E Levi
*Assistant Examiner* — Collin Dawkins
(74) *Attorney, Agent, or Firm* — Jefferson IP Law, LLP

(57) ABSTRACT

An exterior antenna structure of a mobile terminal that may extend the length of an antenna pattern when it is inserted into a case is provided. The exterior antenna structure of the mobile terminal, includes, an exterior antenna including a sleeve extending to an outside of a case, a stopper connected to a lower end of the sleeve, and a pogo pin provided at an inside and a lower end of the stopper, and an additional antenna pattern electrically connected to the pogo pin when the exterior antenna is inserted into an inside of the case. Accordingly, an additional antenna pattern contacting with an exterior antenna may minimize reduction in a passive gain when an exterior antenna is inserted into a case, and a pogo pin provided at a stopper allows an exterior antenna inserted in a case to achieve a stable electric contact with an additional antenna pattern.

13 Claims, 6 Drawing Sheets

EXTERIOR ANTENNA STRUCTURE OF MOBILE TERMINAL

PRIORITY

This application claims the benefit under 35 U.S.C. §119 (a) of a Korean patent application filed on Feb. 24, 2010 in the Korean Intellectual Property Office and assigned Serial No. 10-2010-0016468, the entire disclosure of which is hereby incorporated by reference.

BACKGROUND OF THE INVENTION

1. Field of the Invention

The present invention relates to an exterior antenna structure of a mobile terminal. More particularly, the present invention relates to an exterior antenna structure of a mobile terminal that may extend the length of an antenna pattern when it is inserted into a case.

2. Description of the Related Art

In recent years, in a mobile terminal such as a portable phone, demand for a function of receiving mobile broadcasting, such as Digital Multimedia Broadcasting (DMB), Integrated Services Digital Broadcasting-Terrestrial (ISDB-T), Digital Video Broadcasting-Handheld (DVB-H), Media Forward Link Only (MediaFLO), as well as a voice communication function, is increasing. An exterior antenna such as a whip antenna has been widely used as an antenna for receiving mobile broadcasting. In this case, the exterior antenna can be inserted or extended into or from a case, respectively.

FIG. 1 is a plane view illustrating an exterior antenna structure of a mobile terminal according to the related art.

Referring to FIG. 1, the exterior antenna structure of a mobile terminal includes an exterior antenna 10 with a sleeve 14 and a stopper 16. A head 12 is formed at an upper end of the sleeve 14. A tube 15 is formed at an inner side of the case 11, and guides insertion or extension of the sleeve 14 and the stopper 16 into or from the case 11. A cover 17 is inserted into a lower end of the tube 15 to prevent a stopper 16 from being extended from an inside of the tube 15. A power supply unit 13 is provided at an upper end of the tube 15 to contact with the sleeve 14 or the stopper 16. The stopper 16 is connected to a lower portion of the sleeve 14 by a hinge engagement portion 19.

In the exterior antenna structure of a mobile terminal having the construction mentioned above, since the exterior antenna 10 is inserted into an inside of the case 11 at the time of a scheduled recording of mobile broadcasting, a passive gain is 30 decibels (dB) lower in comparison with a case where the exterior antenna 10 is extended. When a side key and the case 11 of the exterior antenna 10 are made of metal for improving the reliability, a passive gain is 10 dB lower in comparison with a case where they are made of plastic materials.

Therefore, a need exists for an exterior antenna structure of a mobile terminal that may minimize a reduction in a passive gain when an exterior antenna is inserted into a case.

SUMMARY OF THE INVENTION

An aspect of the present invention is to address at least the above-mentioned problems and/or disadvantages and to provide at least the advantages described below. Accordingly, an aspect of the present invention is to provide an exterior antenna structure of a mobile terminal that may minimize a reduction in a passive gain when an exterior antenna is inserted into a case.

In accordance with an aspect of the present invention, an exterior antenna structure of a mobile terminal is provided. The exterior antenna structure includes, an exterior antenna including a sleeve extending to an outside of a case, a stopper connected to a lower end of the sleeve, and a pogo pin provided at an inside and a lower end of the stopper, and an additional antenna pattern electrically connected to the pogo pin when the exterior antenna is inserted into an inside of the case.

According to an exemplary embodiment of the present invention, an additional antenna pattern contacting with an exterior antenna may minimize a reduction in a passive gain when an exterior antenna is inserted into a case. In addition, a pogo pin provided at a stopper allows an exterior antenna inserted in a case to achieve a stable electric contact with an additional antenna pattern.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

Figure 1:
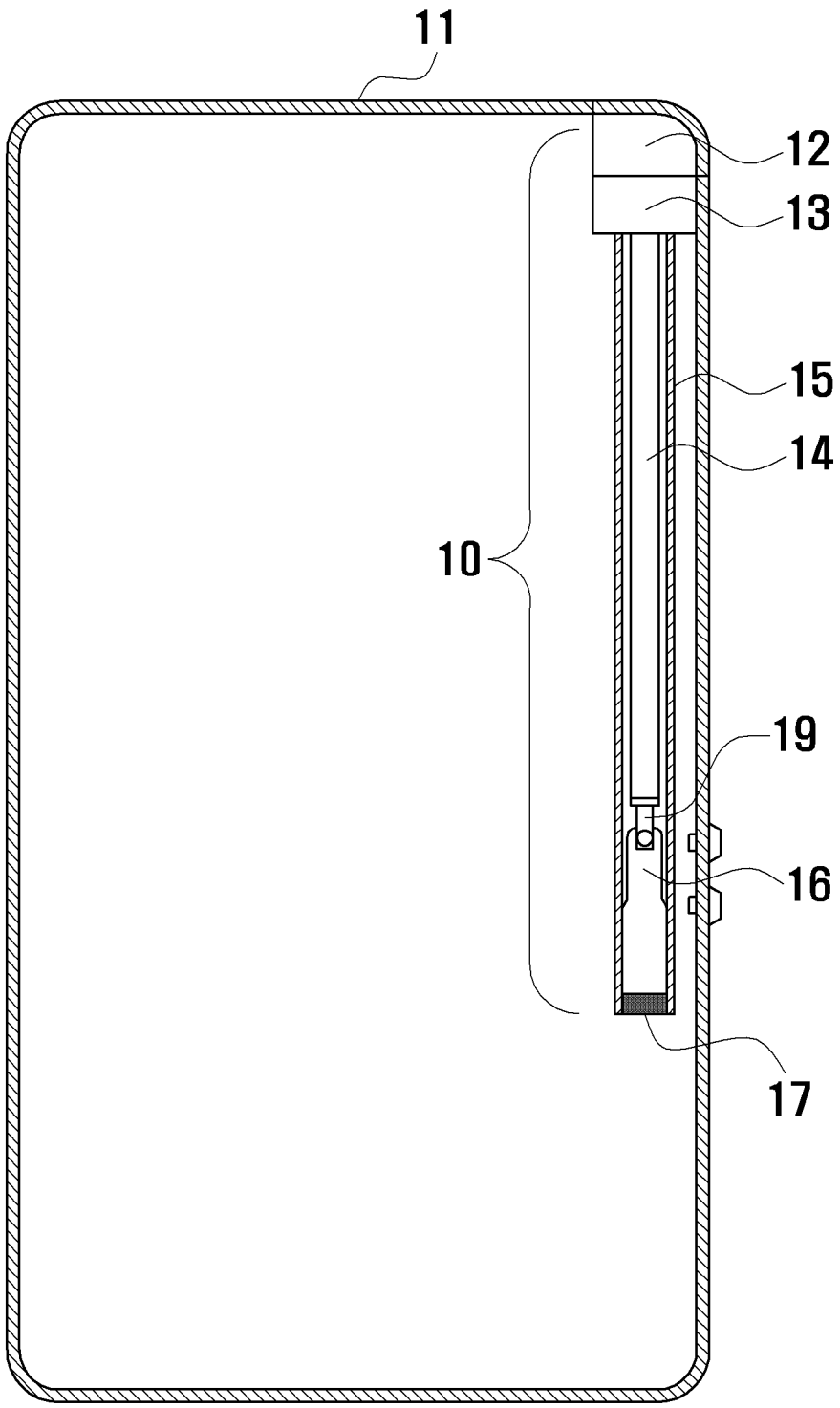
FIG. 1 (RELATED ART)
FIG. 1 is a plane view illustrating an exterior antenna structure of a mobile terminal according to the related art.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Hereinafter, an exterior antenna structure of a mobile terminal according to an exemplary embodiment of the present invention will be described with reference to accompanying drawings.

FIGS. 2 through 6, discussed below, and the various exemplary embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the invention. Terms first, second, and the like are used to differentiate between objects having the same terminology and are in no way intended to represent a chronological order, unless where explicitly state otherwise. A set is defined as a non-empty set including at least one element.

The exterior antenna structure of a mobile terminal according to a first exemplary embodiment of the present invention will now be described with reference to FIGS. 2 and 5.

Figure 2:
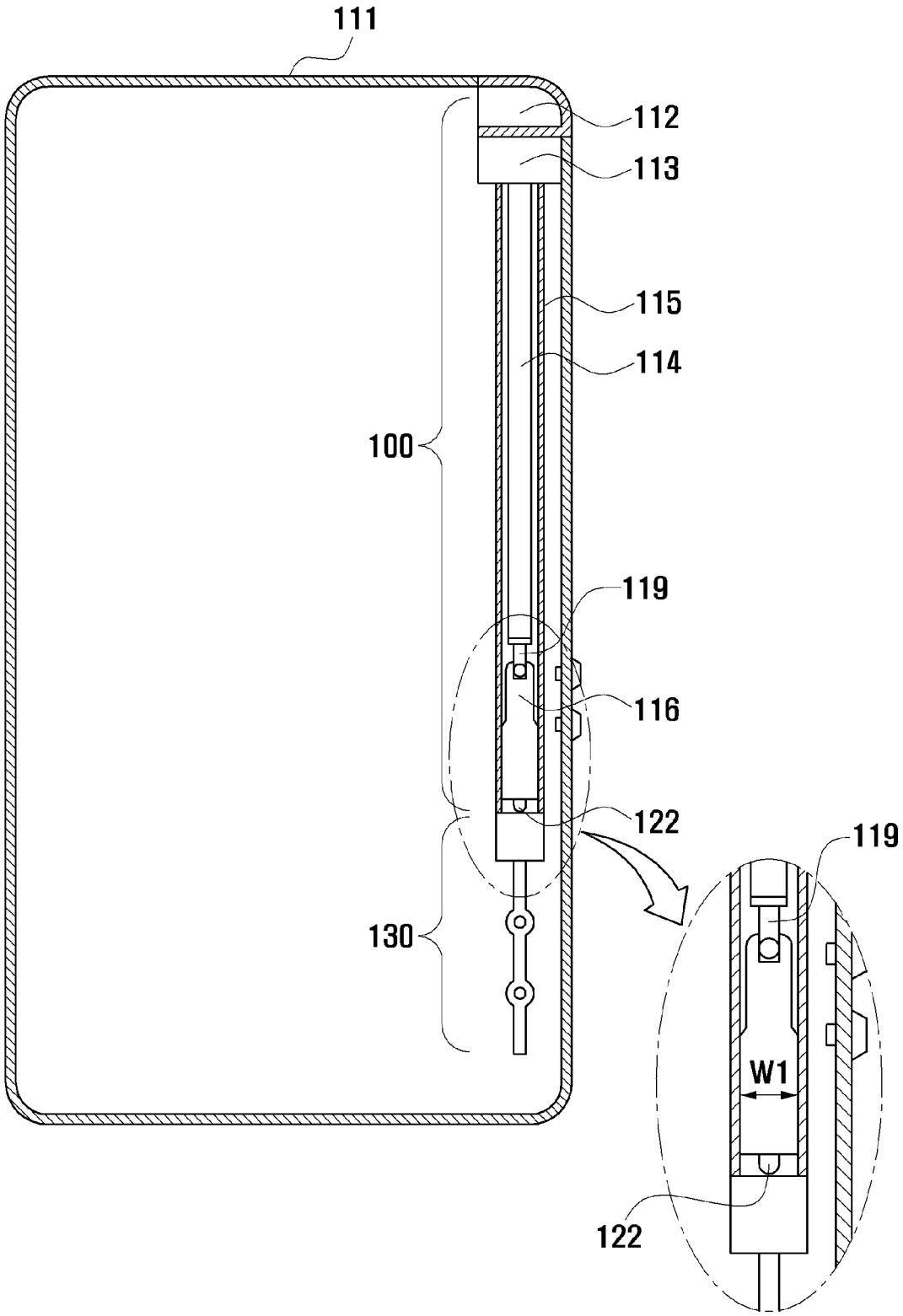
FIG. 2 is a plane view illustrating an exterior antenna structure of a mobile terminal according to an exemplary embodiment of the present invention.
Figure 5:
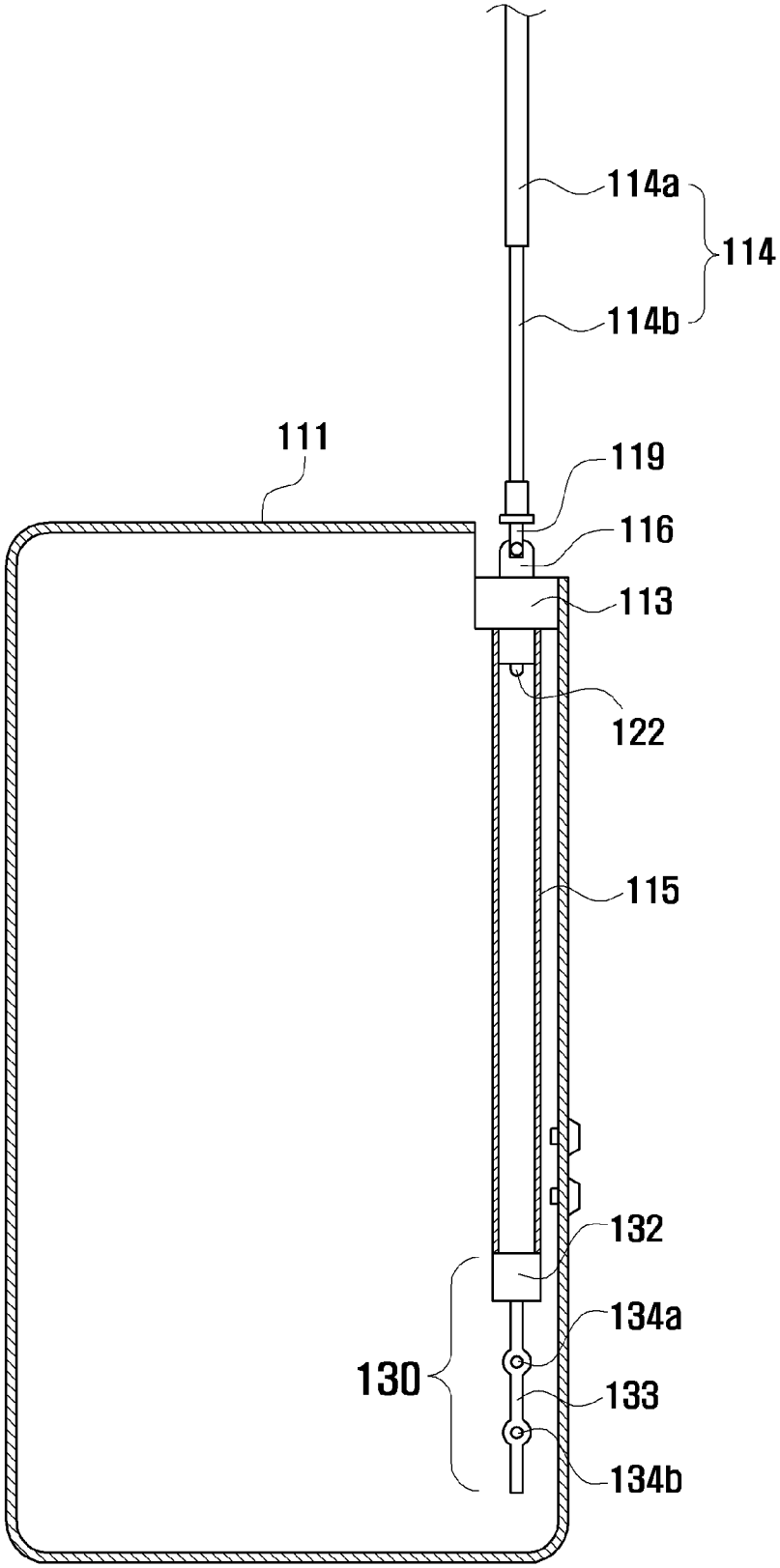
FIG. 5 is a plane view illustrating an extended state of an exterior antenna structure according to an exemplary embodiment of the present invention.

FIG. 2 is a plane view illustrating an exterior antenna structure of a mobile terminal according to an exemplary embodiment of the present invention and FIG. 5 is a plane view illustrating an extended state of an exterior antenna structure according to an exemplary embodiment of the present invention.

Referring to FIG. 2, the exterior antenna structure according to an exemplary embodiment of the present invention includes an exterior antenna 100 and an additional antenna pattern 130. The exterior antenna 100 includes a sleeve 114 and a stopper 116, and a pogo pin 120 (shown in FIG. 3).

The sleeve 114 can be extended to an outside of the case 111. A head 112 forming a corner of the case 111 is provided at an upper portion of the sleeve 114. As shown in FIG. 5, the sleeve 114 preferably includes an outer sleeve 114*a* and an inner sleeve 114*b* such that a length of the sleeve 114 can be extended when the sleeve 114 is extended to the outside of the case 111. A stopper 116, with a width W1, is connected to a lower portion of the sleeve 114 by a hinge engagement portion 119. As shown in FIG. 5, when an entire sleeve 114 is extended, the stopper 116 prevents the exterior antenna 100 from being separated from the power supply unit 113. The sleeve 114 and the stopper 116 are inserted and extended in and from an inside of the tube 115, which is provided at an inner side of the case 111. The tube 115 is preferably made of PolyVinyl Chloride (PVC) materials. The power supply unit 113 is provided at an upper end of the tube 115 contacting with the sleeve 114 or the stopper 116. At a lower end of the stopper 116, a contact pin 122 is provided.

Figure 3:
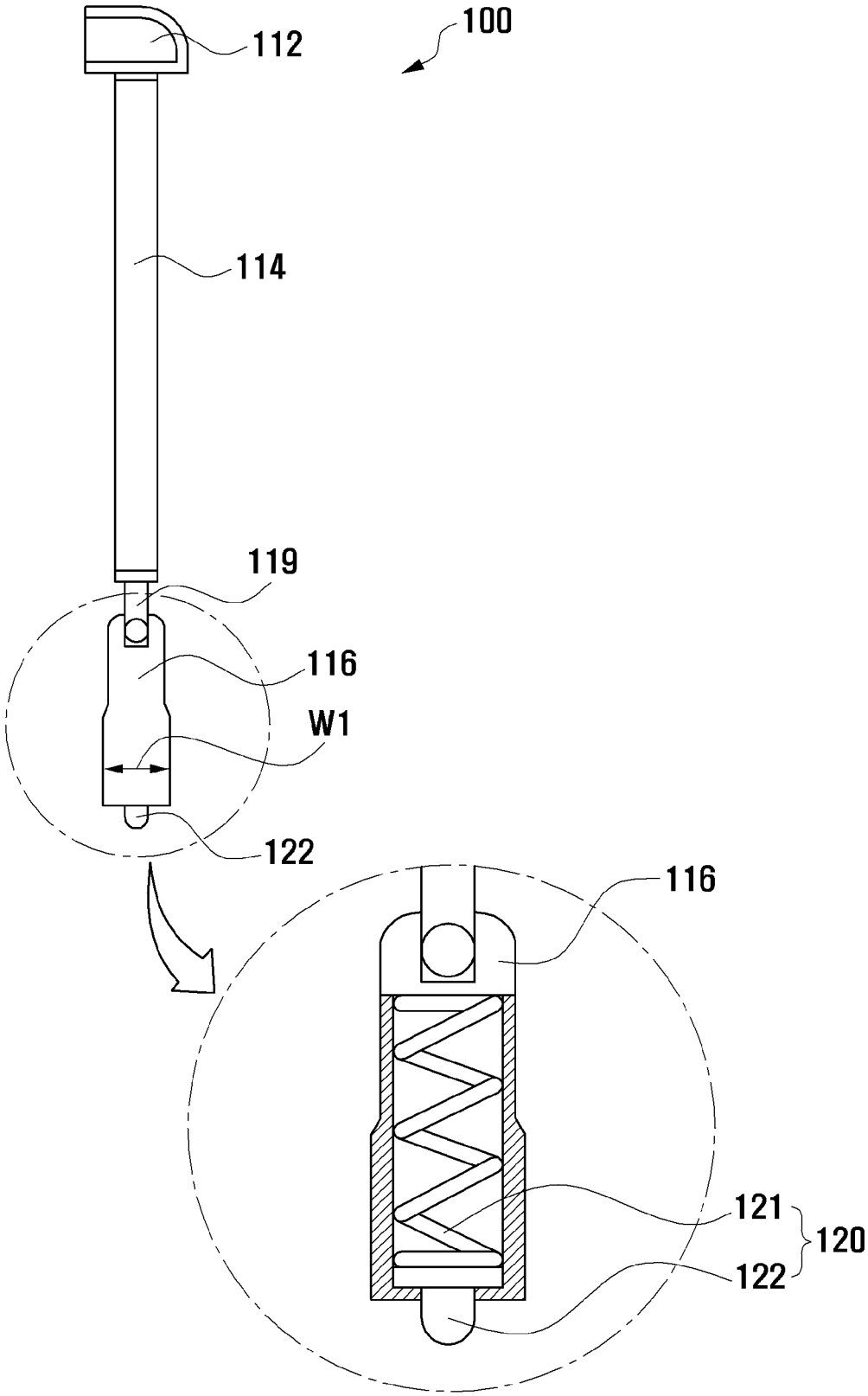
FIG. 3 is a plane view illustrating an exterior antenna and a pogo pin in an exterior antenna structure of a mobile terminal according to an exemplary embodiment of the present invention.

FIG. 3 is a plane view illustrating an exterior antenna and a pogo pin in an exterior antenna structure of a mobile terminal according to an exemplary embodiment of the present invention.

Referring to FIG. 3, the pogo pin 120 is provided at an inside and a lower end of the stopper 116. The pogo pin 120 includes an elastic member 121 and a contact pin 122. The elastic member 121 is provided inside the stopper 116, and the contact pin 122 is provided at a lower end of the stopper 116. When the contact pin 122 is pressurized by the additional antenna pattern 130, the elastic member 121 pushes the contact pin 122 to the additional antenna pattern 130. Although a spring is shown in FIG. 3 as the elastic member 121, a rubber or air/oil pressure absorber capable of pushing the contact pin 122 by an elastic force is also applicable.

An additional antenna pattern 130 is provided at an inside of the case 111 to be electrically connected to the pogo pin 120 when the exterior antenna 100 is inserted into an inside of the case 111.

Figure 4:
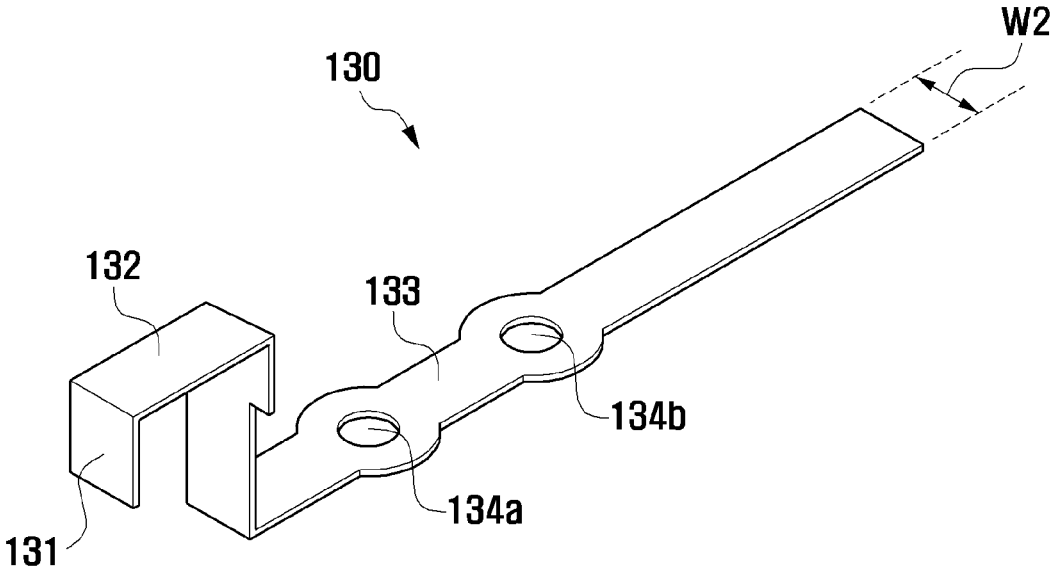
FIG. 4 is a perspective view illustrating an additional antenna pattern according to an exemplary embodiment of the present invention.

FIG. 4 is a perspective view illustrating an additional antenna pattern according to an exemplary embodiment of the present invention.

Referring to FIG. 4, the additional antenna pattern 130 includes a contact portion 131 contacting with the pogo pin 120, a fixing portion 133 fixing the antenna pattern 130 to the case 111, and a connection portion 132 connecting the fixing portion 133 to the contact portion 131. The fixing portion 133 of the additional antenna pattern 130 includes at least one hole 134*a* and 134*b* fixing the fixing portion 133 to the case 111 by fusion. As shown in FIG. 2, the fixing portion 133 extends in a longitudinal direction of the sleeve 114. Further, it is preferred that a width W2 of the fixing portion 133 is smaller than a width W1 of the stopper 116.

In the exterior antenna structure of the portable terminal in this exemplary embodiment of the present invention, when the exterior antenna 100 is inserted in the case 111 to schedule a recording of mobile broadcasting, it is electrically connected to the additional antenna 130. Accordingly, the exterior antenna structure may minimize deterioration of a passive gain when the exterior antenna 100 is inserted in the case 111. More particularly, in comparison with a case where the exterior antenna 100 is inserted, the exterior antenna structure in this exemplary embodiment of the present invention has a passive gain of 10 decibels (dB) greater than an exterior antenna structure of a mobile terminal without an additional antenna pattern 130 as shown in FIG. 1.

Furthermore, in comparison with an experimental result where an exterior antenna is perfectly separated, as shown in FIG. 5, the exterior antenna structure of a mobile terminal in this exemplary embodiment of the present invention in which the external antenna is separated from the additional antenna pattern 130, has a better passive gain than a structure in which the extended exterior antenna contacts an additional antenna pattern.

Moreover, the stopper 116 of the exterior antenna 100 should have a predefined width W1 to prevent the exterior antenna 100 from being separated from the power supply unit 113, and have a substantial straight-line shape to move along a tube 115. However, the width W2 of the additional antenna pattern 130 can be significantly reduced and it is easy to use a shape that is different from a straight line. Accordingly, in the exterior antenna structure of a mobile terminal in this exemplary embodiment of the present invention, an amount of space used in a lower end of the case is higher than that of a structure that only increases a length of an exterior antenna itself.

Figure 6:
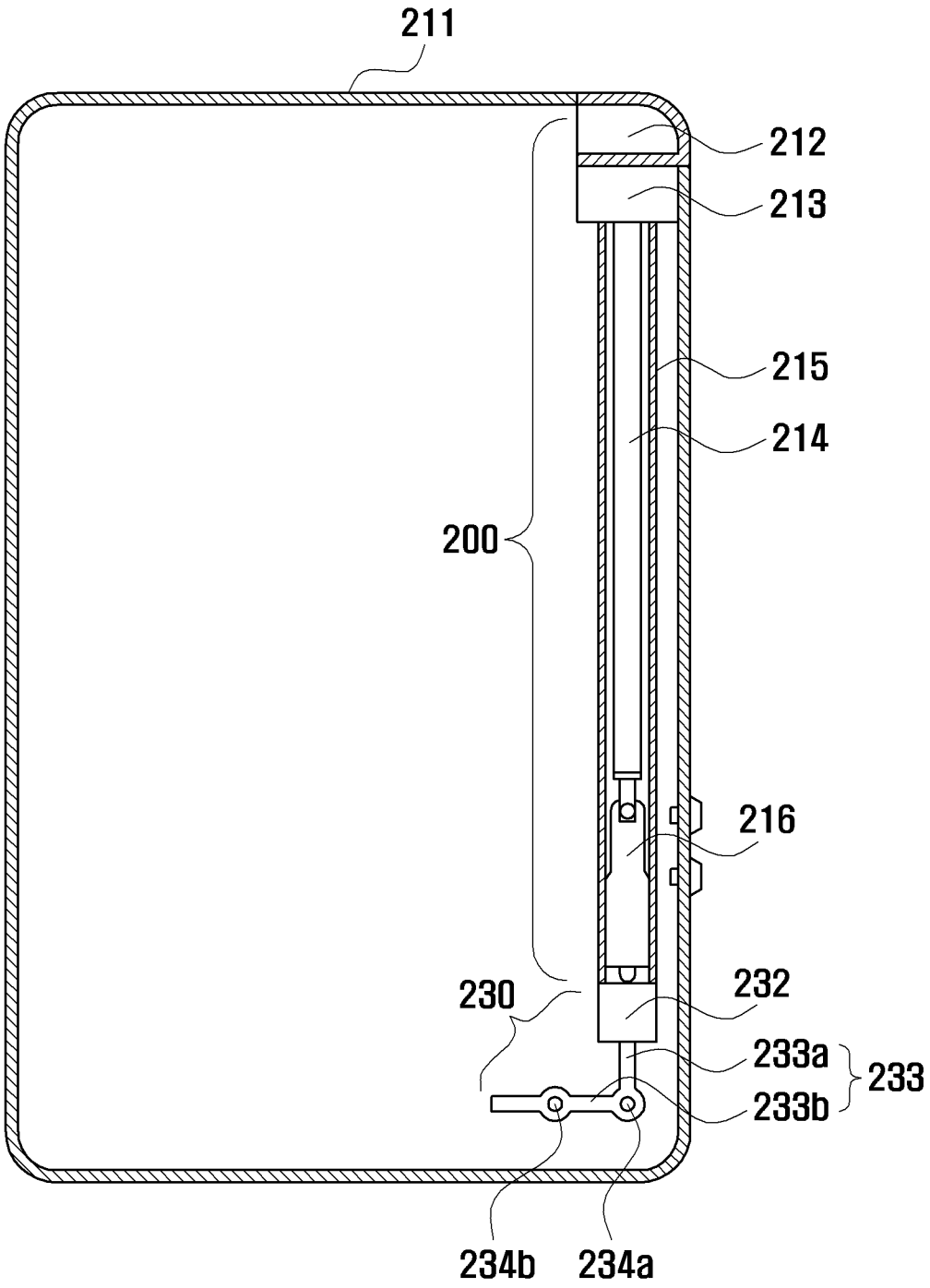
FIG. 6 is a plane view illustrating an exterior antenna structure of a mobile terminal according to an exemplary embodiment of the present invention.

FIG. 6 is a plane view illustrating an exterior antenna structure of a mobile terminal according to an exemplary embodiment of the present invention.

FIG. 6 includes similar features of the exterior antenna structure of FIG. 2. More particularly, exterior antenna 200 includes a sleeve 214 and a stopper 216. The sleeve 214 can be extended to an outside of the case 211. A head 212 forming a corner of the case 211 is provided at an upper portion of the sleeve 214. The length of the sleeve 214 can be extended to the outside of the case 211. When an entire sleeve 214 is extended, the stopper 216 prevents the exterior antenna 200 from being separated from the power supply unit 213. The sleeve 214 and the stopper 216 are inserted and extended in and from an inside of the tube 215, which is provided at an inner side of the case 211.

Furthermore, connection portion 232 connects fixing portion 233 to the contact portion. The fixing portion 233 of the additional antenna pattern 230 includes at least one hole 234*a* and 234*b* fixing the fixing portion 233 to the case 211. An additional antenna pattern 230 of an exterior antenna structure of a portable terminal according to the second exemplary embodiment of the present invention, has a shape different from that of the additional antenna pattern 130 of an exterior antenna structure of a mobile terminal in the first exemplary embodiment of the present invention, shown in FIG. 2. Namely, an upper portion 233*a* of the fixing portion 233 extends in a longitudinal direction of the sleeve 214, and a lower portion 233*b* thereof extends along a lower end of the case 211. Due to the shape of the additional antenna pattern 230 of the second exemplary embodiment of the present invention, the length of a case 211 of the second exemplary embodiment of the present invention may be shorter than that of a case 111 of the first exemplary embodiment of the present invention.

Otherwise, the remaining construction of the second exemplary embodiment of the present invention is identical with that of the first exemplary embodiment of the present invention.

While the invention has been shown and described with reference to certain exemplary embodiments thereof, it will be understood by those skilled in the art that various changes in form and details may be made therein without departing from the spirit and scope of the present invention as defined in the appended claims and their equivalents.

What is claimed is:

1. An exterior antenna structure of a mobile terminal, the exterior antenna structure comprising:

an exterior antenna including a sleeve extending to an outside of a case, a stopper connected to a lower end of the sleeve, and a pogo pin directly connected to a lower end of the stopper, the pogo pin including a contact pin and an elastic member encapsulated by the stopper; and an additional antenna pattern, when the exterior antenna is inserted into an inside of the case, electrically connected to the contact pin of the pogo pin.

2. The exterior antenna structure of claim 1, wherein the contact pin is in contact with a lower end of the elastic member.

3. The exterior antenna structure of claim 1, wherein the additional antenna pattern includes a contact portion contacting with the contact pin of the pogo pin, a fixing portion fixing the additional antenna pattern to the case, and a connection portion connecting the fixing portion to the contact portion.

4. The exterior antenna structure of claim 3, wherein the fixing portion comprises at least one hole fixing the fixing portion to the case by fusion.

5. The exterior antenna structure of claim 3, wherein a width of the fixing portion is smaller than that of the stopper.

6. The exterior antenna structure of claim 3, wherein the fixing portion extends in a longitudinal direction of the sleeve.

7. The exterior antenna structure of claim 3, wherein an upper portion of the fixing portion extends in a longitudinal direction of the sleeve, and a lower portion of the fixing portion extends along a lower end of the case.

8. The exterior antenna structure of claim 1, wherein the sleeve and the stopper are inserted and extended in and from an inside of a tube, which is placed at an inner side of the case.

9. The exterior antenna structure of claim 1, wherein the sleeve includes an outer sleeve and an inner sleeve such that a length of the sleeve can be extended when the sleeve is extended to the outside of the case.

10. The exterior antenna structure of claim 8, wherein a power supply unit is placed at an upper end of the tube to contact with the sleeve or the stopper.

11. The exterior antenna structure of claim 8, wherein the tube is made of a PolyVinyl Chloride (PVC).

12. The exterior antenna structure of claim 1, wherein the stopper is connected to a lower portion of the sleeve by a hinge engagement portion.

13. The exterior antenna structure of claim 10, wherein the stopper of the exterior antenna includes a predefined width to prevent the exterior antenna from being separated from the power supply unit, and a substantial straight-line shape to move along the tube.

* * * * *